US010392760B1

(12) United States Patent
Luk

(10) Patent No.: US 10,392,760 B1
(45) Date of Patent: Aug. 27, 2019

(54) PET REFUSE COLLECTING DEVICE WITH SCOOPING PLATE

(71) Applicant: Tobias Wai Luk, Springfield, MO (US)

(72) Inventor: Tobias Wai Luk, Springfield, MO (US)

( * ) Notice: Subject to any disclaimer, the term of this patent is extended or adjusted under 35 U.S.C. 154(b) by 0 days.

(21) Appl. No.: 16/193,298

(22) Filed: Nov. 16, 2018

(51) Int. Cl.
*E01H 1/12* (2006.01)

(52) U.S. Cl.
CPC ..... *E01H 1/1206* (2013.01)

(58) Field of Classification Search
CPC ..... E01H 1/1206; E01H 2001/128; E01H 2001/1293; E01H 2001/1286
USPC ..... 294/1.3, 1.4, 1.5
See application file for complete search history.

(56) References Cited

U.S. PATENT DOCUMENTS 3,986,744 A 10/1976 Krogstad
4,014,584 A * 3/1977 Bau ..... E01H 1/1206 294/1.4
4,056,278 A * 11/1977 Bau ..... E01H 1/1206 294/1.4
4,272,116 A 6/1981 Tufte, Jr.
4,974,893 A 12/1990 Grahn
5,186,384 A 2/1993 Nelson
5,503,442 A 4/1996 Lee
5,540,470 A * 7/1996 Lu ..... E01H 1/1206 15/257.6
6,418,881 B1 7/2002 Starratt
6,471,267 B2 10/2002 Asazuma
6,648,387 B2 11/2003 Kaplan
6,964,247 B1 11/2005 Lin
3,002,319 A1 8/2011 Hahn
8,408,615 B1 * 4/2013 Patel ..... E01H 1/1206 294/1.4
8,627,974 B2 1/2014 Francis
2004/0145196 A1 * 7/2004 Katz ..... E01H 1/1206 294/1.4
2005/0218675 A1 * 10/2005 Jung ..... E01H 1/1206 294/1.4
2006/0214442 A1 * 9/2006 Jones ..... E01H 1/1206 294/1.4
2007/0194580 A1 * 8/2007 Raasch ..... E01H 1/1206 294/1.4
2008/0136201 A1 * 6/2008 Dong ..... E01H 1/1206 294/1.3
2008/0303295 A1 * 12/2008 Moreno Fernandez De Betono ..... E01H 1/1206 294/1.3
2009/0278365 A1 11/2009 Hawks
2015/0042112 A1 * 2/2015 Briski ..... E01H 1/1206 294/1.4

* cited by examiner

*Primary Examiner* — Gabriela M Puig
(74) *Attorney, Agent, or Firm* — Donald S Debelak

(57) ABSTRACT

A pet refuse collecting device which is designed particularly around animal waste or excrement embodies a moveable metal plate in coordination with a moveable disposable plastic plate with a specially constructed paper bag to create a scooping action to collect waste. The device can move from a 180-degree non-use position to a 90-degree use position with rotation controlled by two mechanical mechanisms, one a pull-out knob that holds the flat plate in either the 180-degree or 90-degree position, and a two-part lever below the handle that operates the clamping mechanism closing the steel plate into the disposable plastic plate and specially constructed paper bag.

7 Claims, 4 Drawing Sheets

PET REFUSE COLLECTING DEVICE WITH SCOOPING PLATE

PRIOR ART US PATENTS

| Pat. No. | Kind Code | Issue Date | Patentee |
|---|---|---|---|
| 3,986,744 | A | 1976 Oct. 16 | David Krogstad, George A. Nigro |
| 4,272,116 | A | 1981 Jun. 9 | Ralph W Tufte, Jr |
| 4,972,116 | A | 1981 Jun. 9 | Paul E. Grahn |
| 5,186,384 | A | 1993 Feb. 7 | Robert J. Nelson |
| 5,503,442 | A | 1996 Apr. 2 | Ke-Cheng Lee |
| 6,471,267 | B2 | 2003 Oct. 29 | Katsuya Katz Asazuma |
| 6,648,387 | B2 | 2002 Jun. 20 | Michael Kaplan |
| 6,964,247 | B1 | 2005 Nov. 15 | Haun-Chin Lin |
| 8,002,319 | B1 | 2011 Aug. 23 | Joseph Hahn |
| 8,627,974 | B2 | 2014 Jan. 14 | Ajax Carl Francis |

PRIOR ART US PATENT APPLICATIONS

| Application # | Kind Code | Publication Date | Applicant |
|---|---|---|---|
| 20090278365 | A1 | 2009 Nov. 12 | Arlen Hawks |

FIELD OF THE INVENTION

The present invention relates to dog waste collection and disposal devices. More specifically, the present invention relates to an inexpensive containment system for capturing dog waste when a pet owner is outdoors with their pet.

BACKGROUND

The collection and proper disposal of pet waste is a concern for today's communities. Major metropolitan cities were the first to realize the hazards of uncollected dog waste, but today it is a concern in all communities. Some municipalities have enacted ordinances to neutralize the pet waste epidemic by requiring owners to dispose of the waste or risk a large fine.

A significant motivation behind the proper collection and disposal of pet is that it carries bacteria, parasites and viruses.

Another important aspect of the pet waste issue is the corresponding environmental impact that is associated with improper disposal. Pet waste that is not sanitarily collected has a high probability of ending up in storm drains that run through our cities, some of which circumvent the local treatment facility opting to feed into local bodies of water.

DISCUSSION REGARDING PRIOR ART

The present invention addresses the prominent shortcomings relating to current pet waste collection and disposal devices. The majority of devices in the art contain similar methods for collecting the waste, which commonly requires a user to bend down below the waist, physically scoop up the waste in some form of a receptacle and then seal the receptacle thereby containing the waste. These devices work well for those who are unable to bend below the waist or who would rather deploy the device with only one hand. Other devices require only one-handed operation while not requiring people to bend over. The drawback to those devices is that they require a complete pickup of the waste in one scoop, and that their pickup device is contaminated with poop until clean. The present invention has a plastic plate on the metal plate which is removed automatically, a hooking device that closes the bag while the user is standing and a compartment that closes the disposable plastic container and the paper bag.

Listed below are some of the more prominent inventions in this field and a description of how they differ from the present invention.

One-handed devices similar to the present invention.

U.S. Pat. No. 3,986,744 (David Krogstad, George A. Nigro) maybe the closest patent to the present invention. It has an open-ended, tubular, scoop-like body and has a flat bottom wall which constitutes a scoop proper and the forward edge of which is provided with comb-like teeth. The plate rotates upwards into a cavity on the device to dispose of the waste. The present invention does not rotate upward, but rather rotates horizontal to the ground depositing the waste into a paper bag that is attached to a plastic plate.

U.S. Pat. No. 5,503,442 (Ke-Cheng Lee) A device for picking up animal feces, comprising a stick member, a D-shape handle mounted on said stick member at one end, a scoop assembly mounted on said stick member at an opposite end, and a control mechanism mounted on said D-shape handle and controlled to open/close said assembly. Again this device plate rotates upward.

U.S. Pat. No. 8,002,319 (Joseph Hahn) this patent is also somewhat close to the present invention. A pick-up device for picking up animal feces, including a stick member, a D-shaped handle mounted on the stick member at one end, a scoop assembly mounted on the stick member at an opposite end, and a control mechanism mounted on the D-shaped handle and controlled to open/close the scoop assembly. The scoop assembly in this device rotates upward, rather than rotating horizontal to the surface.

U.S. Pat. No. 8,627,974 (Carl Ajax Francis) claims a system for the sanitary collection and disposal of pet waste. The system comprises adjacent male and female receptacles connected by a pull string. The male receptacle contains an open bottom for the purpose of being deployed over targeted waste, while the female receptacle contains an opening most adjacent to the male receptacle in order to allow for their joining. The user secures the female receptacle and applies a tension to the pull string, allowing the smaller dimensioned male envelope to be pulled into the female receptacle interior. This device again rotates the bottom plate up.

US20090278365 (Arlen Hawks) has a pickup container but does not have a pick up plate, rather the container slides under the waste for pickup.

Devices requiring two hands rather than the one-handed operation of the present invention.

U.S. Pat. No. 4,272,116 (Ralph W Tufte, Jr) details a collapsible generally rectangular container having an open forward end and an integral handle by which an operator may support and manipulate the container. It also includes a spatula to help place the waste in the container and to enclose the waste.

U.S. Pat. No. 4,972,116 (Paul E. Grahn) includes a container which is slid under the deposit to transfer the waste material to the container. It has a separate device which to push the waste into the container.

U.S. Pat. No. 5,186,384 (Robert J. Nelson) details a receptacle that includes a collapsible container having a selectively sealable opening for enabling access to the interior of the container and an integrated handle for carrying the container. The handle has a detachable scoop stick for gathering up animal waste and placing the wastes in the container through the opening.

U.S. Pat. No. 6,471,267 (Katsuya Katz Asazuma) details a collapsible frame for positioning a flexible membrane to capture and collect animal waste. From a folded, retracted condition capable of being stored in a pocket or easily carried, the present invention springs open using hinges that open to form a polygon frame with an open interior.

U.S. Pat. No. 6,648,387 (Michael Kaplan) claims a canine waste collection device comprising a handle and a frame member, connected to one end of the handle, wherein the frame member comprises a slotted member for receiving and securing of a disposable paper element.

U.S. Pat. No. 6,964,247 (Haun-Chin Lin) claims an excrement container that includes a hollow box body having an opening. The box body and the cover body are connected to a hanging body. A first inner cup and a second inner cup are contained in the box body. The second inner cup is inserted and disposed into the first inner cup. Each inner cup is in a box shape, which can be flattened into a thin flat sheet.

None of the prior art patents discovered include the prominent feature of the present invention which is a scooping plate that rotates parallel to the ground surface.

SUMMARY OF THE INVENTION

The present invention is a containment system device for capturing dog waste utilizing a disposable plastic plate with a paper bag (specially constructed for use in this device) connected to it, and a moveable steel plate. When in operation, the scooping mechanism is turned at a 90-degree angle to the vertical portion of the device, and the steel plate pushes the waste into the paper bag. The operation of the device controlled by two mechanical mechanisms, one a knob near the top of the handle that can be pulled out allowing a internal flat plate to be raised which in turn allows the the steel plate, plastic plate, and paper bag to turn at a 90-degree angle when in use, and a two-part lever below the down from the top of the main structural tube, with the top part of the two-part lever stationary, and with a bottom part can be pulled up towards the handle, which when the leer is pulled doses the hinges which then closes the steel plate into the specially constructed paper bag depositing the waste into the paper bag. The steel plate, the plastic plate, and the paper bag are attached to the vertical section of the device at a 90-degree angle to the tubular vertical portion of the device when in use and are at a 180 degree angle to the vertical portion of the device when not in use. The device includes a hooking device that closes the bag while the user is standing, and also can pull up a detachable tray to prevent waste from escaping the device.

Main components of the Pet Refuse Collecting Device with Scooping Plate are comprised of the following items.

1. A vertical main tubular bar which is the center of the device,
2. A scooping mechanism attached to the bottom of the tubular bar that can rotate from a 90-degree angle to the tubular bar to a 180-degree angle to the tubular bar.
3. A main flat bar within the tubular that is the conduit for action related to the rotation of scooping mechanism 90 degrees, the main flat bar resting inside the vertical support tube is connected to a short flat bar attached to a vertical support plate within the scooping mechanism.
4. A singular cable that runs from the end of the "U" shaped mechanism that is attached to the end of the handle with the singular cable being held in place to the main part of the flat bar with a friction fit When the "U" shaped device rotates 90-degrees from the handle, and the pull-out locking know is in the pulled-out position, the main flat bar is raised. The singular cable attaches through the scooping mechanism housing to a flat plate attached to the vertical support plate. The singular cable moves through the housing, at the location where the flat plate attached to the vertical support plate rest when rotated 90-degrees. Moving the flat plate attached to the vertical support plate will move the scooping device from the 180-degree position (downward position) to the 90-degrees position by rotating the flat bar attached to the vertical support plate 90-degrees.
5. A pull-out locking knob, that sits, when the scooping mechanism is the 180-degree position in top hole of two holes in the flat bar. When the pull-out locking knob is pulled out, and the "U" shaped mechanism on the handle is rotated 90 degrees, the flat bar to move upward, where the knob can be placed in the bottom hole in the flat bar, which holds the scooping mechanism in the 90-degree rotated position. The pull-out locking knob is contained within the tubular bar with wing nuts screws, or other holding devices such as standard screws, which attach to the shaft of the pull-out locking knob. The main vertical has two horizontal slots at the location of the pull-out knob, allowing the pull-out locking knob to move within slots on the main support tube so the pull-out locking knob can be in or out of one of the two holes on the flat bar.
6. A two-part lever near the top of the tubular device, with a stationary top part and a movable bottom part, which when the lever is pulled toward the handle pulls the main cable attached through a connector to two secondary cables that are attached to the ends of the two clamping devices, one on either end of the scooping mechanism causing the clamping devices to move creating the scooping and collection action of the device to occur.
7. A vertical non-tubular rod on the outside of the tubular bar that will release the disposable plastic plate and paper bag for disposal when pushed downward.
8. A scooping collection mechanism on the bottom of the tubular bar consisting of a steels plate on the right-hand side (looking from the front of the device) of the device and a plastic frame on the left-hand side of the device which holds a disposable plastic plate and a specially constructed paper bag for collection. The middle of the scooping mechanism has a vertical support plate that attaches to the sections of the steel support plate and the plastic plate that are in the middle of the scooping mechanism,
9. A clamping mechanism system that moves the steel plate towards and away from the collecting paper bag, the clamp operated by the movement main cable which is moved up and down by the two-part lever near the top of the tubular bar. That main cable attaches through a connector to two cables that go down the vertical support plate and run along the edge of the flat scooping plate and plastic plate to the two ends for the clamping mechanism.
10. A detachable tray which sits below the scooping and collection components when the device is not in use to prevent refuse from escaping.
11. A storage compartment for paper bags and plastic plates and other items.
12. A storage device and dispensing rod for germicide liquid to clean up areas of the sidewalk or other surface that may have waste residue.

13. The vertical support plate within the scooping mechanism that supports both the steel scraping plate and the plastic support frame.

Other potential embodiments of Pet Refuse Collecting Device with Scooping Plate include but are not limited to:

Besides varying heights and shapes for the storage compartment and storage device, the shape of the scooping collection mechanism, and the shape and length of the non-tubular bar, other potential embodiments are listed below:

1. The short connecting bar within the tubular device which turns the scooping collection mechanism to the 90-degree moves can be replaces by a tubular rectangular bar.
2. The vertical tubular bar that is the main support part of the invention could be a square, oval, or rectangular bar.
3. The singular cable starting in the "U" shaped mechanism in in the handle, which allows the device to operate at a 90 degree position when the locking mechanism is turned 90 degrees down from the handle could be a two-part cable, one the cable going from the "U" shaped device to the top of the main flat bar, and the other going from the bottom of the main flat cable through the housing to the bar attached to the vertical support plate.
4. The scooping and collecting mechanism could rotate to angle from 45 to 90 degrees, rather than just 90 degrees.
5. The two-part lever could be a round handle or other shape versus a horizontal bar.
6. The non-tubular bar that closed the collection device could a flat piece, or a tubular bar, or other shape.
7. The detachable tray may be eliminated.
8. The storage compartment may be eliminated,
9. The storage device for disinfectant and dispensing rod may be eliminated,
10. The dispensing rod could be replaced by a hose.

Advantages of the Invention

1. Enables one-handed operation of a pet refuse scooper.
2. Offers an effective method of f picking up pet waste with the 90-degree scooper position into a collection bag.
3. Provides an effective method of waste disposal, disposing of the plastic bag and plastic scraper.
4. The disinfectant and dispensing rod cleans up the area when the pet creates waste in a sensitive or heavily traveled area.
5. The device is easy to operate while the pet leash is held in the other hand.

DRAWINGS

Description of Each Figure

DESCRIPTION OF LABELED COMPONENTS IN THE DRAWINGS

Figure 1:
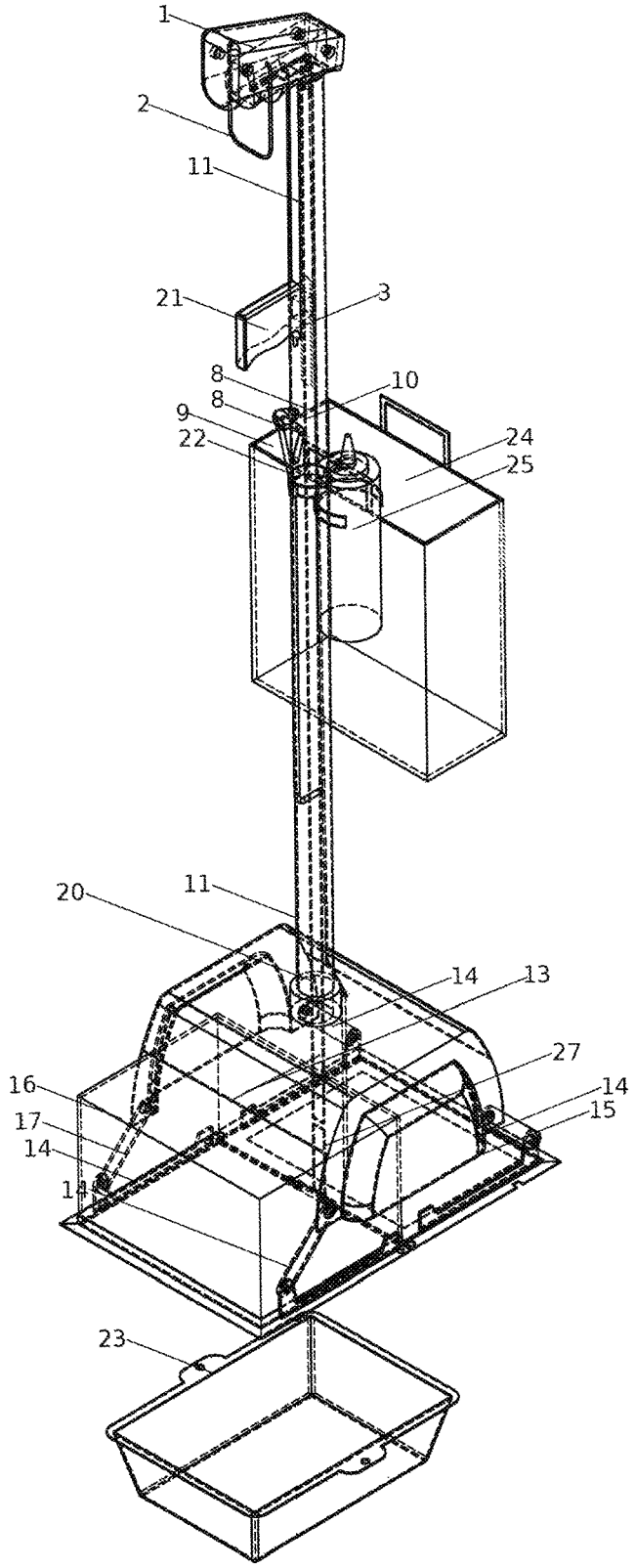
FIG. 1 is a three-quarter overview of the device with the scooping mechanism in the 180 degree, or downward position.

4. A handle.
5. "U" shaped device attached to handle the pulls main flat bar upward.
6. A hole in the top of the flat bar, through which cable 28 is attached before going to the flat bar 18 in the scooping mechanism.
12. Two holes in the flat bar that the pull-out locking knob connects to, if in the 90 degree rotation position, the know should be in the bottom of the two holes.
13. The pull-out locking knob.
14. The main flat bar.
15. The main support tube.
34. Eyelets.
35. The clamping mechanism, one on each side of the scooping mechanism.
36. The steel scooping plate.
37. The frame for the detachable paper bag.
38. The paper bag.
39. A flat bar that is attached to the scooping mechanism. The main cable to the wire frame scooping closing mechanism.
40. The cable from the two-part lever 21.
41. The opening where the cable 27 (see FIG. 4) goes to attach to the eyelet that connects to flat bar attached to the scooping mechanism 18.
42. The two-part lever near the top of the main tube, with a stationary top part, and a lower part that goes up and when squeezed to activate the clamping mechanism 14.
43. vertical non-tubular rod on the outside of the tubular bar that will release the disposable plastic plate and paper bag for disposal when pushed downward.
44. A detachable tray which attaches below the scooping and collection components when the device is not in use to prevent refuse from escaping.
45. A storage compartment for paper bags and plastic plates and other items.
46. A storage device and dispensing rod for germicide liquid to clean up areas of the sidewalk or other surface that may have waste residue.
47. A connector that connects to the main cable which attaches to the two-pan lever 21 and to the to two cables with one cable 36 to the left side clamping device and the second cable to the right side clamping device.
48. Two attachment cables that go either the left or right-side clamping mechanism 14.
49. The singular cable that goes from the "U" shaped device on the handle down to the flat bar on the scooping mechanism.
50. Vertical support plate in the scooping mechanism that both the scooping plate and the plastic frame attach to.
51. Attachment point of the housing sleeve to the main support tube.
52. Extension tube from the attachment point to the housing sleeve to the top plate of the housing.
53. The joint in the extension tube that allows the housing to rotate 90 degrees.
54. Top plate of the housing.
38. Scooping mechanism housing.
39. Cables from the connector 26, one on each side to the housing down each side of the vertical support plate 29 with connecting cables then split in two 37 at the point of the vertical support plate 29, one running down the steel plate 15 to one end of the camping mechanism and the other down the plastic frame 15 down to the other end of clamping mechanism 14.
40. Two auxiliary cables, one to each side of the clamping mechanism.

DETAILED DESCRIPTION OF THE DRAWINGS

FIG. 1 shows the basic configuration of the Pet Refuse Collecting Device with Scooping Plate, The device has a handle 1 on top. With a "U" shaped mechanism 2 (See FIG. 4 for more detail) that moves the flat bar mechanism, 10 and 18 that allows the device to move from a 180-degree to a 90-degree configuration. The flat bar movement is allowed by the pull-out locking knob 9 and two holes 8 in the flat bar 10 which allows the bar to be locked into either the 90-degree or 180-degree configuration. The flat bar 10 has a hole in top 3 which is connected to a cable 28, shown in FIG. 4 which moves the flat bar up and down depending on the position of the "U" shaped mechanism 2.

Near the middle of the main support tube 11 there may be placed a storage compartment for paper bags and plastic plates and other items, 24 and a storage device and dispensing rod 25 for germicide liquid to clean up areas of the sidewalk or other surface that may have waste residue. There is also a removable tray 23 on the bottom that may be placed underneath the scooping mechanism when it is no longer in use.

Figure 3:
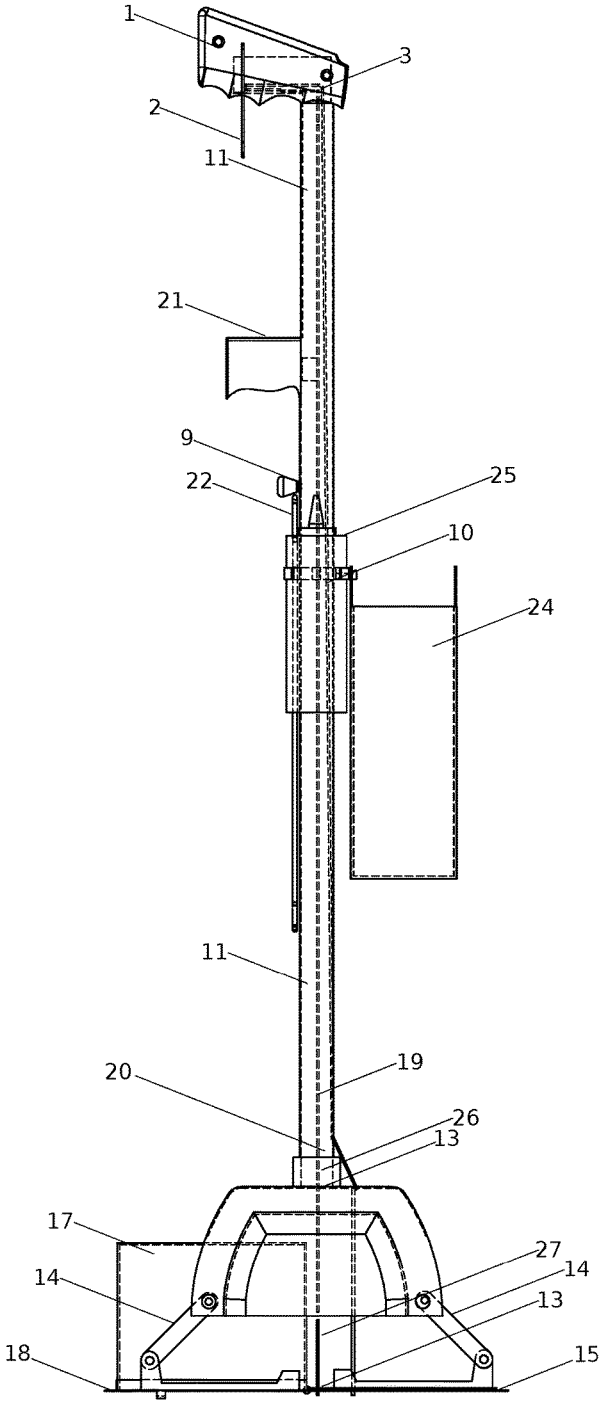
FIG. 3 is a side view of the device of his application, showing how the clamping mechanism works.

The scooping mechanism itself consists of the clamping mechanisms 14 on either side of the scooping mechanism, see FIG. 3 for more detail, a steel scooping plate 15, which scoops the waste material into a paper bag 17, which is held in place by a disposable plastic frame 16. FIG. 1 also shows the two eyelets, 13, which allow the cable 28 (see FIG. 4) from the handle 1 through the top hole in the flat bar 3 to manipulate the flat bar 18 attached to the scooping mechanism, which has the cable 28 attached to the end of the flat bar 18.

Figure 2:
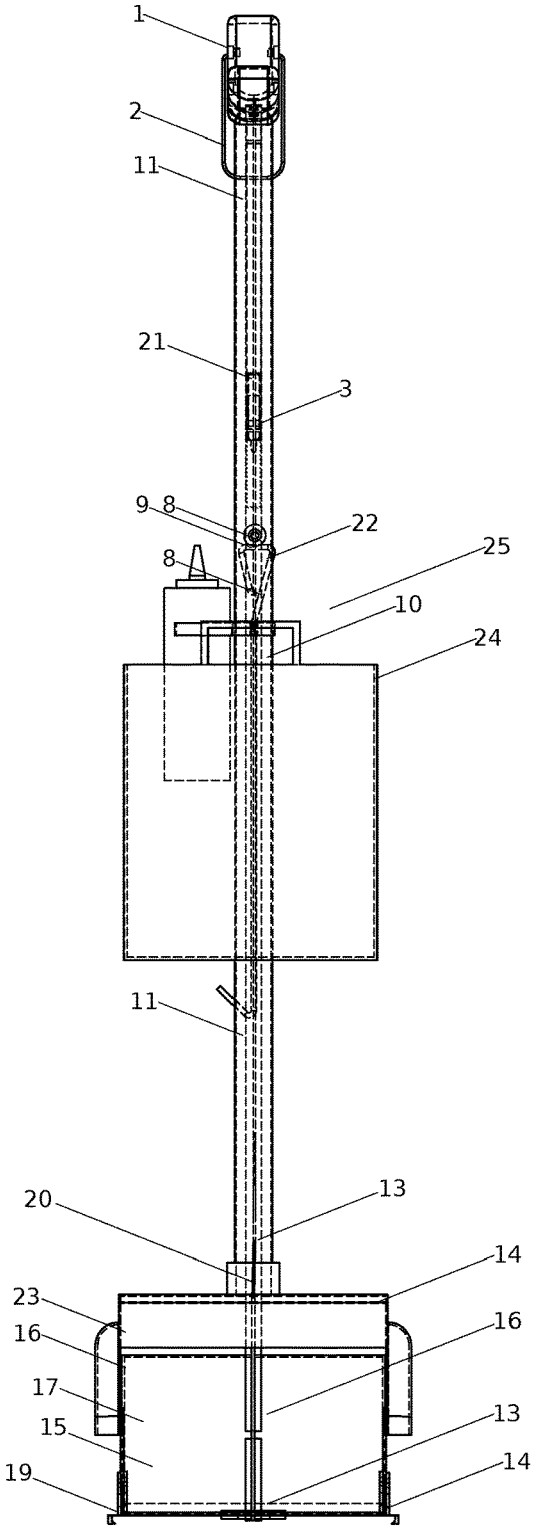
FIG. 2 is a front view of device of this application with the scooping mechanism at a 90-degree angle.

FIG. 2 illustrates the scooping mechanism when it is turned at a 90-degree angle. The clamping mechanism 14 is on the top and bottom of the scooping mechanism. The steel plate 15 is on the left side (looking towards the drawing, and plastic frame 16 for the paper bag 17 is on the right side looking toward the picture.

FIG. 3 shows the clamping mechanism from one side of the device. The main cable 19 from the two-part lever 21 goes into a connector 26, which then has two cables, 27 one to the clamping mechanism 14 on either side of the scooping mechanism. When the cable 19 is pulled up by use of the two-part lever, the two clamping mechanisms closes causing the scooping action.

Figure 4:
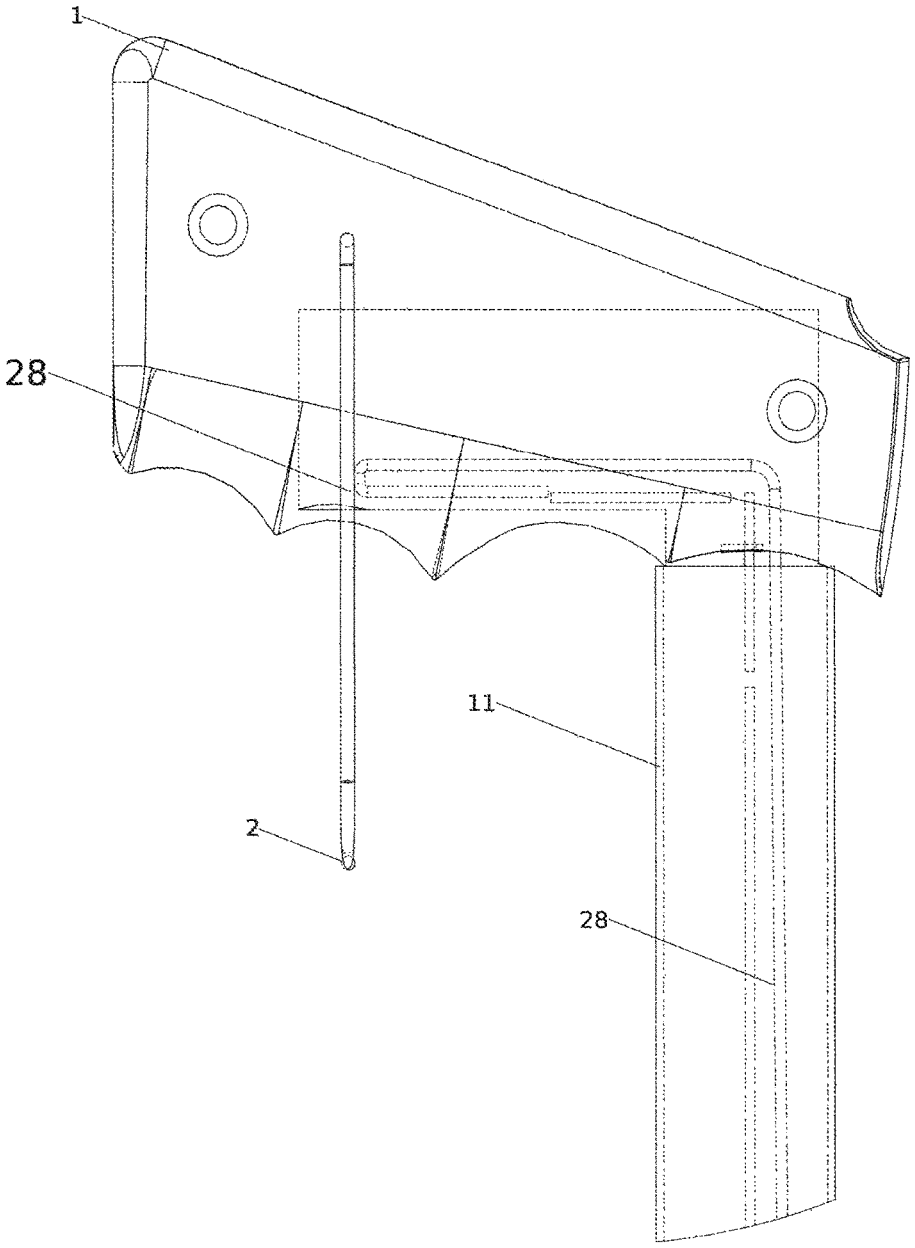
FIG. 4 is a view of the handle and the "U" shaped locking device and its connection to the cable that raises the flat bar.

FIG. 4 shows the handle 1 with the "U" shaped mechanism 2. The locking mechanism 2, is attached to the cable 28. When the "U" shaped mechanism 2 is pulled down, it pulls the cable 28 which raises the main flat bar 10, as the cable 28 is wrapped through the flat bar 10, which in turn raises the flat bar 18 attached to the scooping mechanism housing turning the scooping mechanism 90-degrees. In order for all the above to happen the pull-out locking knob 9, must be pulled out and then reinserted once the flat bar 18 has reached its 90-degree hole.

I claim:

1. A pet refuse collecting device with a scooping mechanism, where the scooping mechanism can have the scoop facing down, at a 180-degree angle, to a main support tube, or rotated to a 90-degree angle, to the main support tube comprising:

- a singular cable running from a "U" shape device on a handle, through a hole in the top of a main flat bar contained within the main support tube, through a scooping mechanism housing, connecting to a flat bar attached to a vertical support plate;
- the hole on the top of the main flat bar preventing the singular cable from slipping through the hole with a tight friction fit;
- the main flat bar with two holes;
- a pull-out locking knob, that allows a flat tube to be raised or lowered, into a position where one of the two holes in the main flat bar align with the pull-out locking knob, with one hole positioned with the locking knob for holding the pet refuse collecting device's scooping housing at a 180-degree position, and the other hole positioned with the locking knob for holding the pet refuse collecting device's scooping housing at a 90-degree position;
- a flat bar attached to the vertical support plate whose end is attached to the singular cable;
- a joint in a connection tube from a connection point on the main support tube to a connecting point of the top support plate of the scooping mechanism housing;
- whereby, when the "U" shaped device on the handle is rotated down 90-degrees, with the pull-out locking knob in the pulled out position, the singular cable is pulled upward which moves the main flat bar upward, causing the singular cable connected to the end of the flat bar attached to vertical support plate in the scooping mechanism housing, to rotate the scooping mechanism housing 90-degrees, at which time the pull-out locking knob is released into the 90-degree hole in the main flat bar securing the scooping mechanism into the 90-degree position.

2. The device of claim 1, with a two-part lever and main cable system to activate the scooping and collection action of the device comprising:

- a lever with a stationary top section and a moveable bottom section;
- a main cable with one end attached to the bottom section of the lever;
- a connector near the bottom of the main support tube with the main cable attached the connector top and two auxiliary cables connected to bottom of the connector;
- two clamping mechanisms with two ends, one clamping mechanism on each side of the scooping mechanism housing;
- two ends of the auxiliary cables split into two secondary cables, with each secondary cable connected to an end of the clamping mechanism;
- whereby, when the bottom section of the lever is pulled up, the main cable is raised up the two ends of the secondary cables to pull the clamping mechanism opens and shut creating the scooping action of the device.

3. The device of claim 1 with a detachable tray which sits below the scooping and collection components when the device is not in use to prevent refuse from escaping.

4. The device of claim 1 with a vertical non-tubular rod on the outside of the main support tube bar that will release the disposable plastic plate and paper bag for disposal when pushed downward into the removable tray.

5. The device of claim 1 with a storage compartment for paper bags and plastic plates and other items.

6. The device of claim 1 with a storage compartment for germicide liquid and a dispensing rod to clean up areas of the sidewalk or other surface that may have waste residue.

7. The device of claim 1 with the singular cable starting in "U" shaped mechanism in the handle, which allows the device to operate at a 90 degree position when the "U" shaped mechanism is turned 90 degrees down from the handle could be a two-part cable, one cable going from the "U" shaped device to the top of the main flat bar, and the other going from the bottom of the main flat cable through the housing to the bar attached to the vertical support plate.

* * * * *